US006709219B2

(12) United States Patent
Reed, III

(10) Patent No.: US 6,709,219 B2
(45) Date of Patent: Mar. 23, 2004

(54) REAR-LOAD TRANSFER SYSTEM

(76) Inventor: Thomas I. Reed, III, 18221 E. Layton Pl., Aurora, CO (US) 80015

( * ) Notice: Subject to any disclaimer, the term of this patent is extended or adjusted under 35 U.S.C. 154(b) by 0 days.

(21) Appl. No.: 10/144,428

(22) Filed: May 11, 2002

(65) Prior Publication Data

US 2003/0210973 A1 Nov. 13, 2003

(51) Int. Cl.[7] ..... B65F 9/00
(52) U.S. Cl. ..... 414/400; 414/495; 100/218
(58) Field of Search ..... 414/400, 495; 100/229 A, 218

(56) References Cited

U.S. PATENT DOCUMENTS

| | | | | | |
|---|---|---|---|---|---|
| 3,318,231 | A | * | 5/1967 | Felts | 100/229 A X |
| 3,662,910 | A | * | 5/1972 | Herpich et al. | 414/400 |
| 3,753,506 | A | * | 8/1973 | Palmer et al. | 414/400 |
| 3,966,096 | A | * | 6/1976 | Worthington | 222/389 |
| 4,125,196 | A | * | 11/1978 | Liberman et al. | 414/400 |
| 4,538,512 | A | * | 9/1985 | Blough | 100/229 A |
| 4,919,979 | A | * | 4/1990 | Gardella et al. | 428/2 |
| 5,148,739 | A | * | 9/1992 | Fox | 100/45 |
| 5,624,225 | A | * | 4/1997 | Cox | 414/495 |
| 6,309,164 | B1 | * | 10/2001 | Holder et al. | 414/406 X |
| 6,328,522 | B1 | | 12/2001 | Martz | |

FOREIGN PATENT DOCUMENTS

| | | | |
|---|---|---|---|
| FR | 2572370 | * | 5/1986 |
| JP | 840505 | * | 2/1996 |
| JP | 11165805 | * | 6/1999 |
| WO | 0076820 | * | 12/2000 |

* cited by examiner

*Primary Examiner*—Steven A. Bratlie
(74) *Attorney, Agent, or Firm*—Barber Legal; Craig W. Barber

(57) ABSTRACT

The present invention teaches a waste container, especially a roll-off waste container, having a gate at one end, a waste transfer system to push wastes within the container out the gate, and lifting devices which raise the container to approximately the level of a garbage truck's hopper. The hopper may be the fixed rear hopper of a rear-load truck or a special container for a front load truck. The present invention furthermore teaches a new system for waste handling. Wastes are placed into a container, the container is raised, and the wastes are transferred to a garbage truck. The present invention may be used industrially, in construction, in residential settings, and commercially. The invention may be opened at sides or tops to meet the user's waste disposal needs, and may be connected to a building by a trash chute as is commonly used in compactor applications.

22 Claims, 9 Drawing Sheets

REAR-LOAD TRANSFER SYSTEM

FIELD OF THE INVENTION

This invention relates to generally to waste handling and specifically to a system by which roll-off containers may transfer wastes to a rear-load garbage truck.

REFERENCE TO DISCLOSURE DOCUMENT

The present invention is the same device taught in USPTO Disclosure Document 506804, dated Feb. 25, 2002 and date stamped by the OIPE Mar. 5, 2002, to the same inventor, Thomas Reed III, and entitled "Process and Apparatus for Transferring Solid Waste".

BACKGROUND OF THE INVENTION

For large quantities of waste, the normal commercial trash container (usually called a "DUMPSTER", this exact mark is registered to Dempster Systems Inc, Knoxville Tenn., having no relationship to the present applicant. Numerous other marks make use of the word "DUMPSTER".) a metal box roughly two meters tall by three meters long by two meters from front to back is quite often inadequate. For example, construction sites often generate waste which is both of considerably greater volume and may be of a size such that one dimension or more will not fit into a standard trash bin.

For this purpose, a large standard size is commonly used, the "roll-off" container. The roll-off trash container may be the same size as a standard container with the roof and some of the upper walls removed, or may be other sizes normally several times larger than a normal commercial trash bin. The roll-off container is designed so that it may be rolled on and off the back of a specially equipped flat-bed truck. The normal manner of employment of a roll-on roll-off container may be understood by reference to FIG. 1 through FIG. 4 of U.S. Pat. No. 6,332,746, issued Dec. 25, 2001 to Lang et al, a convenient example of the use of a hoist truck. A large truck with a specially equipped hoist backs up to the trash container from one end. The hoist is raised and attached to the container and the container is slowly lifted until it is suspended along the length of the hoist. The hoist/container combination is then lowered back to the bed of the truck. It is significant that the container is thus left on the bed of the truck behind the cab, it is NOT emptied into the truck: the truck has no separate waste holding container. The truck driver drives the truck with the container on its bed to the appropriate sanitary landfill facility for disposal of the waste within the container. Then the driver returns to the work-site and repeats the same process in reverse as he returns the roll-off container to those who require it as a trash receptacle.

There are numerous complications and uncertainties in this process. First and foremost, the roll-off container may be attached at the front end to a building: such an arrangement is common behind supermarkets, department stores and other large establishments. In this case, the driver is forced to perform the following operations: back up to the accessible end of the container, disconnect the roll-off container from the building, hook the accessible back end of the container to the hoist, lift it up or pull it on its rollers, move the truck a short distance, unhook the container from the hoist, drive the truck around and back it up to the front end of the container, hook the front end of the container to the hoist, raise it onto the hoist, lower the hoist to the bed of the truck, and then begin driving the container to the landfill. The entire process must be reversed in order to put the container back in place when the driver returns.

The expensive hoist-equipped truck is not as flexible as the normal rear-load garbage truck: since it has no built in waste container, and compaction blades, it cannot be used in the residential setting; since it also lacks a mechanism for lifting of a conventional commercial waste bin, it cannot be used with such bins.

In addition, while the container is suspended on the hoist above the back of the truck, it is possible for the waste in the container to fall out of the container, resulting in man-hours of clean-up work. Worse, the waste may shift in the container and may conceivably be massive enough to upset the stability of the truck, though this is rare. More commonly, it is necessary to provide special devices on the roll-off hoist truck in order to cover the open container, without such devices the truck may be in violation of the law, may be charged a premium at the landfill facility, or may allow waste to blow out of the container during transit.

In addition, during the period of time when the driver is making the round trip with the container to the landfill and back, the container is unavailable to the end user. Thus the disposal contractor must add to the cost of the hoist truck by committing an empty container to each truck at the start of the day's route in order to allow "daisy-chaining" of the individual stops on the route. Even then, however, the truck and driver must after each stop on the route make a substantial trip to the landfill. In most major metropolitan areas, the landfills are located at some distance from the city center, thus making for a normally long round trip. Some major metropolitan areas suffer from 24 hour congestion, in which areas the number of runs a single driver can make in a single day may dwindle to a few, or even one.

In terms of energy usage, a large truck making multiple daily round-trips to the landfill represents a large use of petroleum products or other energy sources. In every metropolitan area, there are fleets of such trucks doing this. Thus, the present invention offers the ability to provide great energy savings. In addition to fuel, the environmental aspect of this is quite large. The emissions generated by a single truck may be greatly reduced by use of the present invention. Such airborne pollution is becoming a greater issue due to global warming, depletion of the ozone layer, metropolitan growth and an increased understanding of the health hazards of such air pollution.

By contrast, it should be noted that the smaller commercial waste bin ("DUMPSTER") is simply lifted up by a garbage truck, the trash received, and the bin is put back down. Garbage trucks for handling of the two meter by three meter by two meter commercial waste bin may be either "front loading" in which the bin is lifted over the cab of the truck and inverted, or "rear-loading." The rear-load garbage truck is the familiar type of garbage truck often used in residential settings. When modified to handle a commercial waste bin, the bin is lifted at the back of the truck and the trash is transferred to the compaction blades at the back of a normal read-load garbage truck, and the bin is put back down. In addition, such trucks are covered and thus may be advantageously equipped with compaction blades. Such compaction blades are invaluable in reducing trips to the landfill: the volume of the wastes handled may be reduced by a factor of 10 to 1 or more from the volume as it is left in the trash can by the residential or commercial customer. Such compaction is obviously impossible for a hoist truck which simply carries the large trash container as it was filled by the customer.

U.S. Pat. No. 6,296,132 issued Oct. 2, 2001 to Picker teaches a universal DUMPSTER which is usable in several different modes. It may be used as a roll-off, as a front load, carried on a trailer, etc. It teaches doors at one end and an open top. However it does not teach legs to lift the roll-off container, an internal blade to empty it, connection to a conventional rear-load truck, etc.

U.S. Pat. No. 5,607,277 issued Mar. 4, 1997 to Zopf teaches a garbage can which is picked up by the waste truck. The can in the '277 patent is emptied into an intermediate container. Again, most of the features taught by the present invention are missing from this item of prior art.

U.S. Pat. No. 5,427,497 issued Jun. 27, 1995 to Dillman teaches a horizontal surge/storage silo. The structure and concept are otherwise different from the present invention: there are no hydraulic legs on the container, there is no hydraulic connection to a truck, rear-load garbage trucks may not be used, etc.

U.S. Pat. No. 5,348,125 issued Sep. 20, 1994 to Stribling teaches a self contained hydraulic power unit for waste compactors. An electrical connection is made from a vehicle to the hydraulic power unit on the compactor, and the electricity used to drive the compactor. No transfer of waste is suggested, no hydraulic legs or hydraulic connection is established, and the device deals with stationary compactors.

U.S. Pat. No. 5,317,963 issued Jun. 7, 1994 and U.S. Pat. No. 5,083,510 issued Jan. 28, 1992 to Hohlt teach another type of stationary compactor, seemingly in the smaller commercial size waste bin.

U.S. Pat. No. 5,214,594 issued May 25, 1993 to Tyler et al teaches a "network" for multiple trash compactors and measurement of pressure on the blade in order to determine fullness.

U.S. Pat. No. 5,092,233 issued Mar. 3, 1992 teaches the TRASH COLLECTION AND STORAGE SYSTEM which something very like an airport jetway. An indoor trash hopper or compactor feeds wastes to the conveyor system inside the device, the device itself pivots outwards from the building and may extend as well, in order to match up with a rear-load garbage truck and convey waste thereto. On the indoors side of the device, a hinged platform may be raised or lowered (see FIGS. 7A, 7B). Overall there are numerous structural and conceptual differences between this device and the present invention: lack of any roll-off container, lack of hydraulic connection to the truck, a lack of vertical adjustment (hydraulic legs) to match with the rear-load truck, the fact that this is a "through the wall" system, lack of a compaction blade as the to-truck-transfer mechanism, and so on. In addition, since this is a building waste chute rather than a mobile container, it is a different art.

U.S. Pat. No. 4,643,087 issued Feb. 17, 1987 to Fenner et al teaches a system for measuring fullness of a waste compactor container. Other than being an example of a container with a compactor/blade, it does not disclose features of the present invention: legs to lift the container, transfer by blade pressure to a rear-load truck, and others.

U.S. Pat. No. 4,557,658 issued Dec. 10, 1985 and U.S. Pat. No. 4,372,726 issued Feb. 8, 1983 to Lutz teach another waste compactor container, this time with two compartments for wastes. It is otherwise unrelated to the invention.

U.S. Pat. No. 3,787,830 issued Jan. 22, 1974 to Cato et al teaches as trap door type arrangement to indicate when a compactor/container is full of trash, and is otherwise unrelated to the invention.

It is also known in the art, though not disclosed by applicant's search of the US PTO database of granted patents, to have a container having an ejector blade and wet line ports by which to receive hydraulic power. These devices are used in the known method of cleaning of such containers (hoisting the container onto a truck, conveying it to a land-fill facility, and raising it to let waste slide out the back). On occasion, the waste refuses to slide out the back. At that time, the ability to eject the waste by forcing the blade down the length of the container is beneficial. However, there is no known art in which the container may raise itself, nor transfer wastes to garbage truck.

It would be advantageous to allow rear-load garbage trucks, with their advantage of compaction blades, covered waste holding spaces, and flexibility to service roll-off containers. Such hoppers are capable of 10:1 compaction or more, and are equipped with blades which grab items in the hopper and pull them further in, compacting as they go. It would further be advantageous to allow service by rear-load, front-load and hoist trucks. It would further be advantageous to provide a means by which one truck could service a plurality of containers before making a round trip to the landfill. It would further be advantageous to allow transfer of wastes from containers to rear-load trucks. It would further be advantageous to avoid the nuisance and uncertainty of hoisting containers.

SUMMARY OF THE INVENTION

General Summary

The present invention teaches a waste container, especially a roll-off waste container, having a gate at one end, a waste transfer system to push wastes within the container out the gate, and lifting devices which raise the container to approximately the level of a garbage truck's hopper. The hopper may be the fixed rear hopper of a rear-load truck or a special container for a front load truck.

The present invention furthermore teaches a new system for waste handling. Wastes are placed into a container, the container is raised, and the wastes are transferred to a garbage truck.

The present invention may be used industrially, in construction, in residential settings, and commercially. The invention may be opened at sides or tops to meet the user's waste disposal needs, and may be connected to a building by a trash chute. The legs, gate, and transfer device may be hydraulically actuated, electrical, or may be actuated in other ways.

Allowing servicing of roll-off containers by conventional garbage trucks as several advantages: it reduces the number of special roll-off hoist trucks required, it allows the garbage trucks to compact the wastes after transfer and it permits covered carrying of waste loads without special equipment.

The apparatus may be actuated by being hooked to the hydraulic supply of the servicing truck, or from another nearby source, or it may have a self-contained power supply. A valve body mounted on the side of the apparatus, or a remote control device, may be used for control of operations.

The apparatus may advantageously be substantially the same width as the hopper of a rear-load garbage truck.

The invention may also replace known compactors in use by large commercial establishments, either free-standing compactors, or compactors attached to buildings, due to the fact that the invention also has compactor embodiments.

The invention may also advantageously comprise a transfer station. In this embodiment of the invention, waste may be transferred from other containers or from garbage trucks to the container of the invention, where it may be stored pending servicing of the invention and transfer to a land-fill facility.

Summary in Reference to Claims

It is one objective, embodiment, aspect and advantage of the present invention to provide a method of loading waste to the hopper of a garbage truck, comprising the steps of:

a) allowing waste to be placed into a waste container having a body and having at least one lifting device and further having at least one end;

b) raising the waste container by means of the at least one lifting device to approximately the level of the hopper; and c) transferring the waste to the hopper.

It is yet another objective, embodiment, aspect and advantage of the present invention to provide a method of loading waste wherein the lifting device comprises at least one extendable leg.

It is yet another objective, embodiment, aspect and advantage of the present invention to provide a method of loading waste wherein the extendable leg is hydraulically actuated.

It is yet another objective, embodiment, aspect and advantage of the present invention to provide a method of loading waste wherein the waste container further comprises a hydraulic connection from the garbage truck, and wherein the hydraulic actuation of the extendable leg is accomplished by supplying fluid and pressure through the hydraulic connection from the garbage truck.

It is yet another objective, embodiment, aspect and advantage of the present invention to provide a method of loading waste wherein the extendable leg is electrically actuated.

It is yet another objective, embodiment, aspect and advantage of the present invention to provide a method of loading waste wherein the waste container further comprises roll-on/roll-off equipment.

It is yet another objective, embodiment, aspect and advantage of the present invention to provide a method of loading waste wherein the waste container further comprises a transfer device suitable for carrying out the step of transferring the waste to the hopper.

It is yet another objective, embodiment, aspect and advantage of the present invention to provide a method of loading waste wherein the waste container further comprises a gate at one end of the waste container and further wherein the transfer device further comprises a actuated blade dimensioned and configured so as to force waste within the waste container out through the gate when the hydraulically actuated blade is activated.

It is yet another objective, embodiment, aspect and advantage of the present invention to provide a method of loading waste further comprising the step of:

d) compacting the waste in the garbage truck.

It is yet another objective, embodiment, aspect and advantage of the present invention to provide a method of loading waste wherein the step of raising the waste container further comprises raising one end of the waste container.

It is yet another objective, embodiment, aspect and advantage of the present invention to provide a method of loading waste wherein the step of raising the waste container further comprises raising all of the body of the waste container.

It is yet another objective, embodiment, aspect and advantage of the present invention to provide a method wherein the step of allowing waste to be placed within the container further comprises placing such waste in the waste container from a source selected from the group consisting of: smaller waste containers, garbage cans, commercial waste containers, rear-load garbage trucks, front-load garbage trucks, hoppers, waste receptacles, and combinations thereof.

It is yet another objective, embodiment, aspect and advantage of the present invention to provide a waste container for use with the waste receptacle of a garbage truck, the waste container comprising:

a body; and at least one lifting device capable of raising at least one end of the container to approximately the level of the waste receptacle and capable of lowering the waste to approximately ground level.

It is yet another objective, embodiment, aspect and advantage of the present invention to provide a waste container wherein the garbage truck further comprises a rear-load garbage truck and wherein the waste receptacle further comprises the hopper of the garbage truck.

It is yet another objective, embodiment, aspect and advantage of the present invention to provide a waste container wherein the garbage truck further comprises a front-load garbage truck and wherein the waste receptacle further comprises an open-topped waste container.

It is yet another objective, embodiment, aspect and advantage of the present invention to provide a waste container wherein the lifting device comprises at least one extendable leg.

It is yet another objective, embodiment, aspect and advantage of the present invention to provide a waste container further comprising: a spot mirror located so as to allow a driver of a truck to monitor waste within the container.

It is yet another objective, embodiment, aspect and advantage of the present invention to provide a waste container further comprising:

at least one remote receiver used to control operations of the invention from a remote location.

It is yet another objective, embodiment, aspect and advantage of the present invention to provide a waste container wherein the width of the body is approximately equal to the width of such waste receptacle of such garbage truck.

It is yet another objective, embodiment, aspect and advantage of the present invention to provide a waste container wherein the width of the body is in the range from 36 to 98 inches, preferably in the range from 60 to 84 inches, most preferably in the range from 70 to 72 inches.

It is yet another objective, embodiment, aspect and advantage of the present invention to provide a waste container further comprising:

a gate dimensioned and configured so as to both swing open horizontally and slide open vertically.

It is yet another objective, embodiment, aspect and advantage of the present invention to provide a waste container further comprising:

a hydraulic gate cylinder operatively connected to the gate and dimensioned and configured so as to force the gate open vertically when the hydraulic gate cylinder is actuated.

It is yet another objective, embodiment, aspect and advantage of the present invention to provide a waste compactor for use with the waste receptacle of a garbage truck, the waste compactor comprising:

a body;

a compaction device; and at least one lifting device capable of raising at least one end of the compactor to approximately the level of the waste receptacle and capable of lowering the waste compactor to approximately ground level.

DETAILED DESCRIPTION

Figures 1, 7:
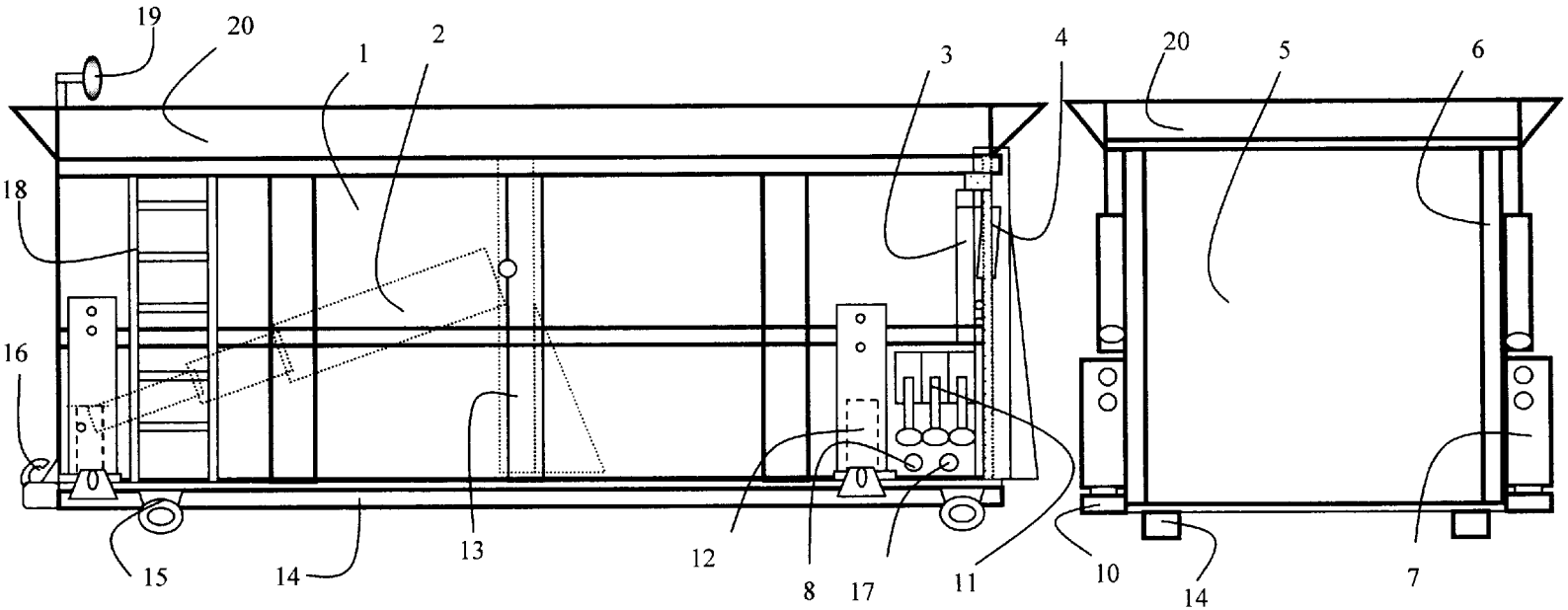
FIG. 1 is a side view of a first embodiment of the invention.
FIG. 7 is an end view of the first embodiment of the invention.

The presently preferred embodiment of the present invention, and the best mode now contemplated for carrying out the present invention, are disclosed in FIG. 1 and FIG. 7.

Body 1 comprises an open or closed top waste container. Hydraulic ejector cylinder 2 is connected to transfer blade 13. Hydraulic gate cylinder 3 is used to open gate 4 by lifting door 5. Door 5 and gate 4 have seal 6 which maintains the integrity of body 1, so that wastes do not easily flow out between door 5 and gate 4.

Hydraulic legs 7 and 12 have pivoting feet 10 which allow the invention to conform to uneven ground. In other embodiments, feet 10 may have extenders which allow them to conform in length to differing terrain, or other equivalent devices.

Ports 8 and 17 are dimensioned and configured to accept "wet lines", that is, hydraulic lines from another source. Thus, in the presently preferred embodiment, the invention does not have an independent supply, source or reservoir of hydraulic fluid, nor does it have a pressure generator able to apply pressure to the hydraulic system, legs, gate cylinders, ejector cylinder or other devices. In the preferred embodiment, hydraulic fluid and pressure is supplied externally via ports 8 and 17. In alternative embodiments, the invention may have any one of hydraulic supply, source, reservoir, master cylinder, or pressure generator, or it may simply have a complete self-contained hydraulic system.

Hydraulic valve body/control panel 11 may be mounted at any convenient location on the invention, however, in the preferred embodiment and best mode presently contemplated, hydraulic valve body 11 and ports 8 and 17 are located in a place convenient to the operator of the garbage truck (not shown in FIG. 1). For example, these structures may be located close to the hydraulic valve body/control panel of the garbage truck compactor blades. Hydraulic hard lines lead from the valve body to the individual cylinders.

Embodiments having ladder 18 provide easy access to the interior or top of the container. Spot mirror 19 may be used by the driver of the garbage truck or roll-off truck to monitor the container and its contents. For example, by means of spot mirror 19 the driver of a rear-load garbage truck may determine if illegal or dangerous substances are within the invention, without climbing ladder 18. It may also be used by the driver to determine if anything in the container is too long to pass safely through the compaction blades of a rear-load garbage truck. It may also be used by the driver of a roll-on hoist truck to determine if waste is shifting, blowing out of the vehicle, falling out etc. It may also be used by the driver of either a garbage truck or a hoist truck to position themselves during their approach to the invention.

On a routine basis, the driver may also use spot mirror 19 to determine if any waste is falling behind the blade as the waste is ejected. Thus the driver can halt or reverse operation of the blade in order to allow the waste to eject cleanly, and will be made aware of the need for any potential manual clean-up required by falling waste.

In embodiments, flange 20 is angled outwards from the top of body 1 in order to increase capacity and decrease spillage.

In use, loading waste may be accomplished by bringing it to the container and raising it over the side of the container, and over the top of flange 20, before dropping it into body 1. Note that in other embodiments, loading waste may be accomplished by other methods.

In the preferred embodiment and best mode now contemplated, the invention is also equipped with roll-on/roll-off equipment. Guide rails 14 slide onto and off the tracks of a hoist truck, when the unit is being moved or when it is being serviced by a hoist truck rather than a rear-load garbage truck. Rollers 15 are also necessary for this process. Hook 16 may be part of either the traditional cable style hoist system or part of the newer style hook box design. In other embodiments, roll-on/roll-off equipment is not needed. It will be appreciated that the invention may be embodied in a wide variety of waste containers: commercial size bins, ("DUMPSTERS") other sizes and shapes of bins, non-roll-off containers, small trash cans, and so on. Any waste container may embody the invention with the addition of the limitations and elements disclosed and claimed in this application for patent.

While ejector blade 13 and cylinder 2 (which are dimensioned and configured so as to force waste within the waste container out through the gate when the hydraulically actuated blade is activated) are used in the preferred embodiment, other types of transfer devices fall within the scope of the appended claims. While door 5 may lift vertically, other types of doors may be used, depending upon the receiving vehicle, space requirements and other considerations. For example, in embodiments the door may be hinged at the top and open automatically when the ejector is activated, or may swing (side-hinged) or may open in other ways. While in the preferred embodiment hydraulic cylinders are used to raise the gate, hydraulics, electrics or other devices may be used to open the gate, or it may operate manually, or (for example in the top-hinged embodiment) the gate may have a strong retaining spring which urges the door shut until greater pressure is applied by means of a transfer or ejector mechanism.

While in the preferred embodiment the lifting device comprises four hydraulically actuated legs, in alternative embodiments the legs may be fewer or greater in number, may be angled, or may be placed by equivalent lifting devices.

The width of the invention's body is of importance. If the body is considerably wider than the waste receptacle of the receiving garbage truck, during ejection it may spill wastes out on one or both sides of the garbage truck. If it is considerably narrower, the process may be unduly prolonged and the container may be of excessive length or height in order to compensate. Thus in one embodiment of the invention, the width of the body of the invention is approximately the same as the width of the waste receptacle or hopper of the garbage truck servicing the invention. This width may range from 36 inches to 98 inches, more preferably from 60 inches to 84 inches, most preferably from 70 to 72 inches. These widths are approximations, of course, as equipment on the garbage truck may project inwards and thus effectively narrow the hopper. For example, on one model of truck the trunnion latches may have posts projecting towards the centerline of the hopper, thus reducing a 72 inch hopper to an effective width of 71 inches in that spot. The term "approximately equal" includes a body slightly narrower or wider than the truck's waste receptacle to account for such equipment, for the efficiency of having the body be very slightly narrower than the receptacle in order to make backing up to the container easier and transfer more tidy, and so on.

The rear end of the invention (located at the ejector ram and ejector blade) may be open, thus allowing easy access to the hydraulic ejector cylinder and ejector blade, and making it easy for an operator to clean up any garbage which, during the course of ejection, comes over the top of the blade and falls back within the body of the container in an un-advantageous location behind the blade.

The front end, having the gate, functions as both a door and a gate: it opens both vertically upwards and yet also swings sideways. Gates dimensioned and configured so as to both swing open horizontally and slide open vertically are not known in the waste management application. Use as a gate, preferably hydraulically actuated, allows the container to be serviced in accordance with the present invention: by a garbage truck, without being transported elsewhere. Use as a door is advantageous because it allows the invention to function as a known roll-off container: the operator may hoist it onto a hoist-truck, convey it to a land-fill facility, open the door manually, and raise it to dump the contents.

Figure 2:
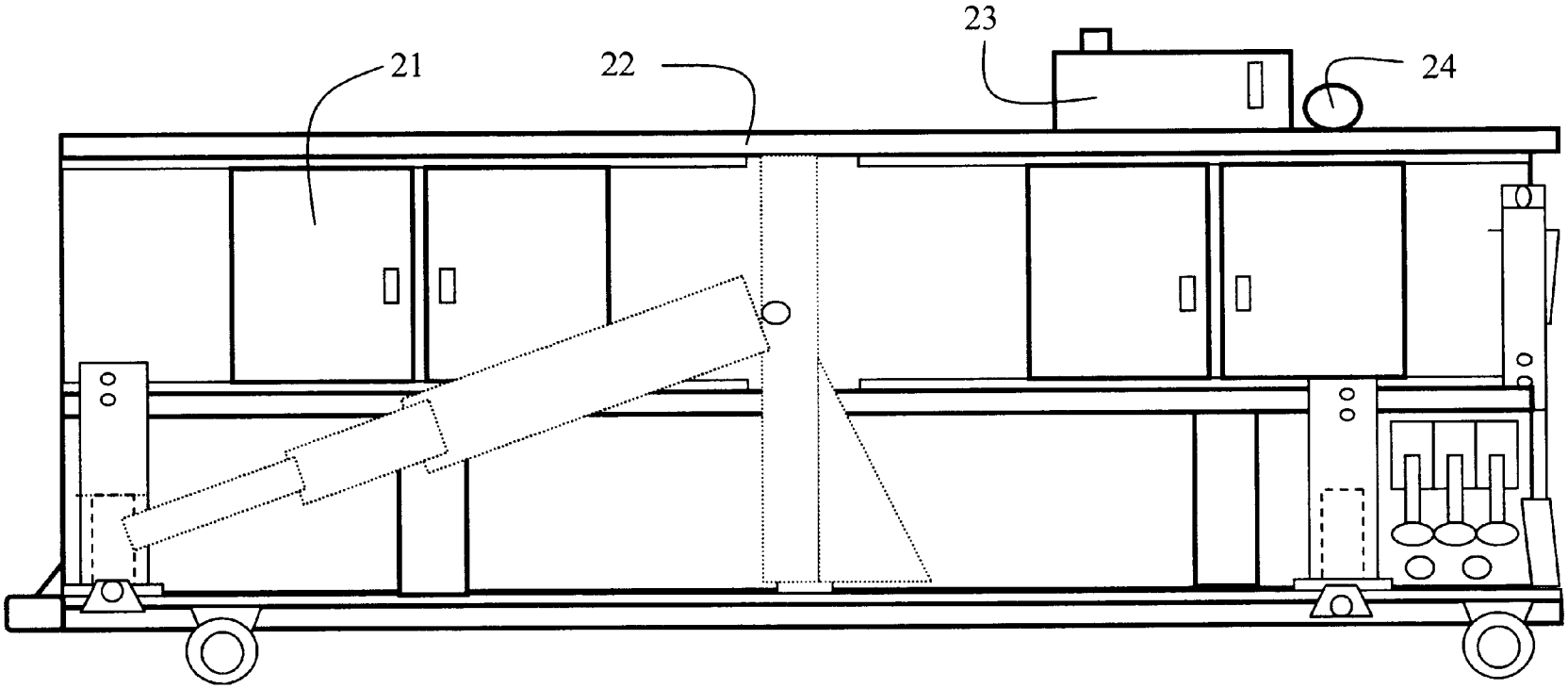
FIG. 2 is a side view of a second embodiment of the invention.

FIG. 2 shows an alternative embodiment having a roof 22 and side access doors 21. Side access doors 21 may be used for loading waste. Users will bring waste/trash/garbage/recycling or other items to be disposed off, thrown away, removed, given away or otherwise transported elsewhere by means of the present invention to the side access doors 21, open the side access doors 21, and drop or place the item inside of the invention.

In this embodiment, hydraulic tank 23 and motor 24 are integral to the invention, thus avoiding the necessity for servicing trucks to supply hydraulic fluid and pressure. In alternative embodiments, the hydraulic tank and motor may be located and either permanently or temporarily emplaced near to the invention, for example, on a concrete pad, in a small housing or shed, in a waste bin corral, in a nearby structure and so on.

Figure 3:
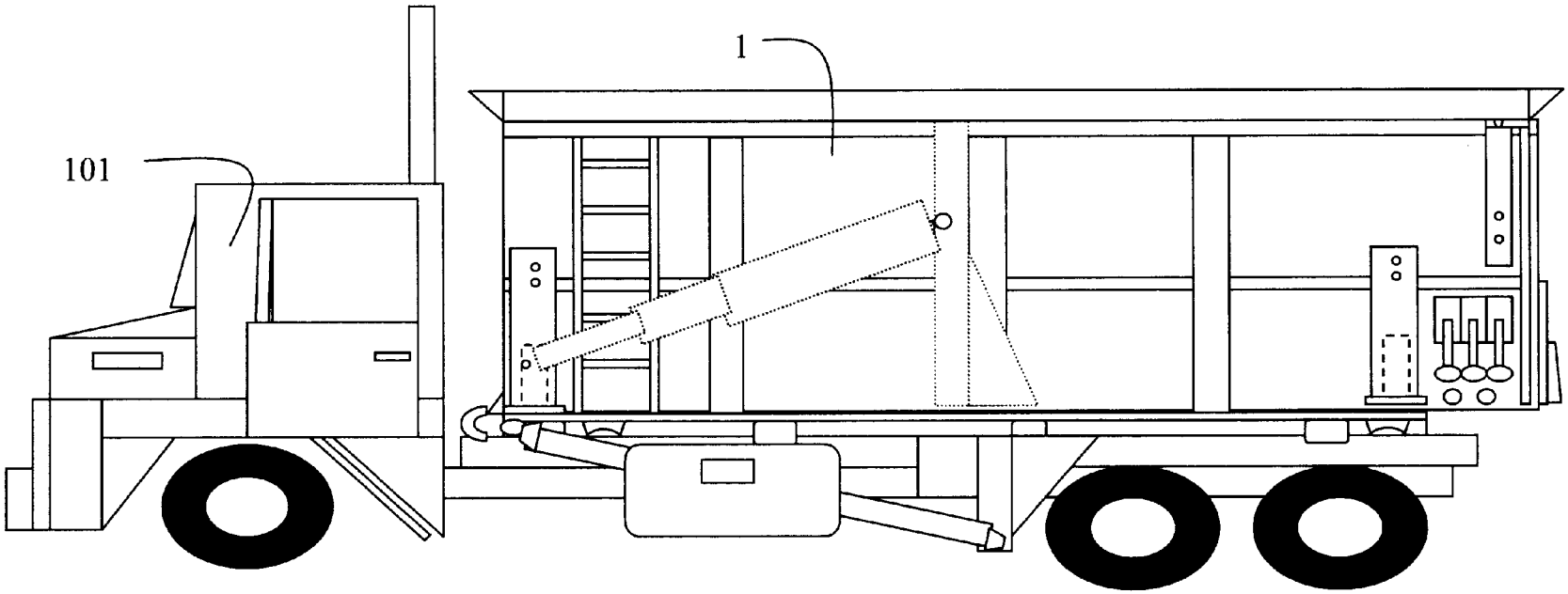
FIG. 3 is a side view of the invention carried by a roll-off hoist truck.

FIG. 3 shows the invention body 1 when being serviced by a hoist truck 101, while actually on the bed of the roll-off hoist truck 101, behind the cab. The hoist is lowered for road travel. The mode of servicing of the invention is only preferred for delivery, replacement, transport and removal of the invention and when the invention contains materials for which servicing by a front or rear loading garbage truck is not appropriate. For example, users may place long and strong items such as girders lengthwise into the invention. Such items would not transfer easily according to the method of the invention, making traditional roll-off servicing a necessity. For this reason, the preferred embodiment of the invention (previously shown in FIG. 1) has roll-off/roll-on equipment. In addition, the preferred embodiment has a gate which lifts in accordance with the present invention but also swings sideways as known in the art, so as to facilitate both modes of servicing: conventional and by means of rear-load transfer.

Figure 4:
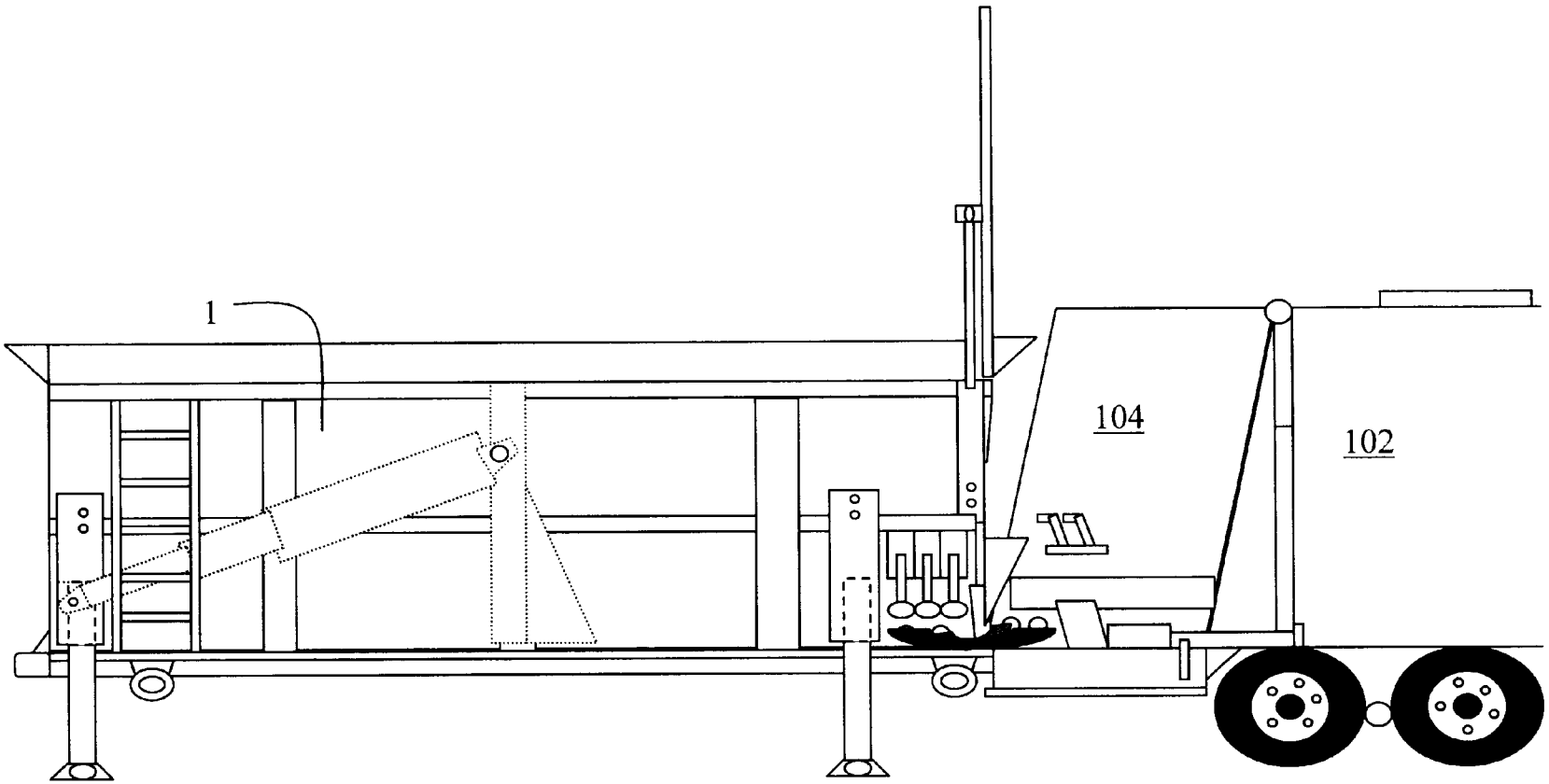
FIG. 4 is a side view of the first embodiment of the invention being serviced by a rear-load garbage truck.
Figure 5:
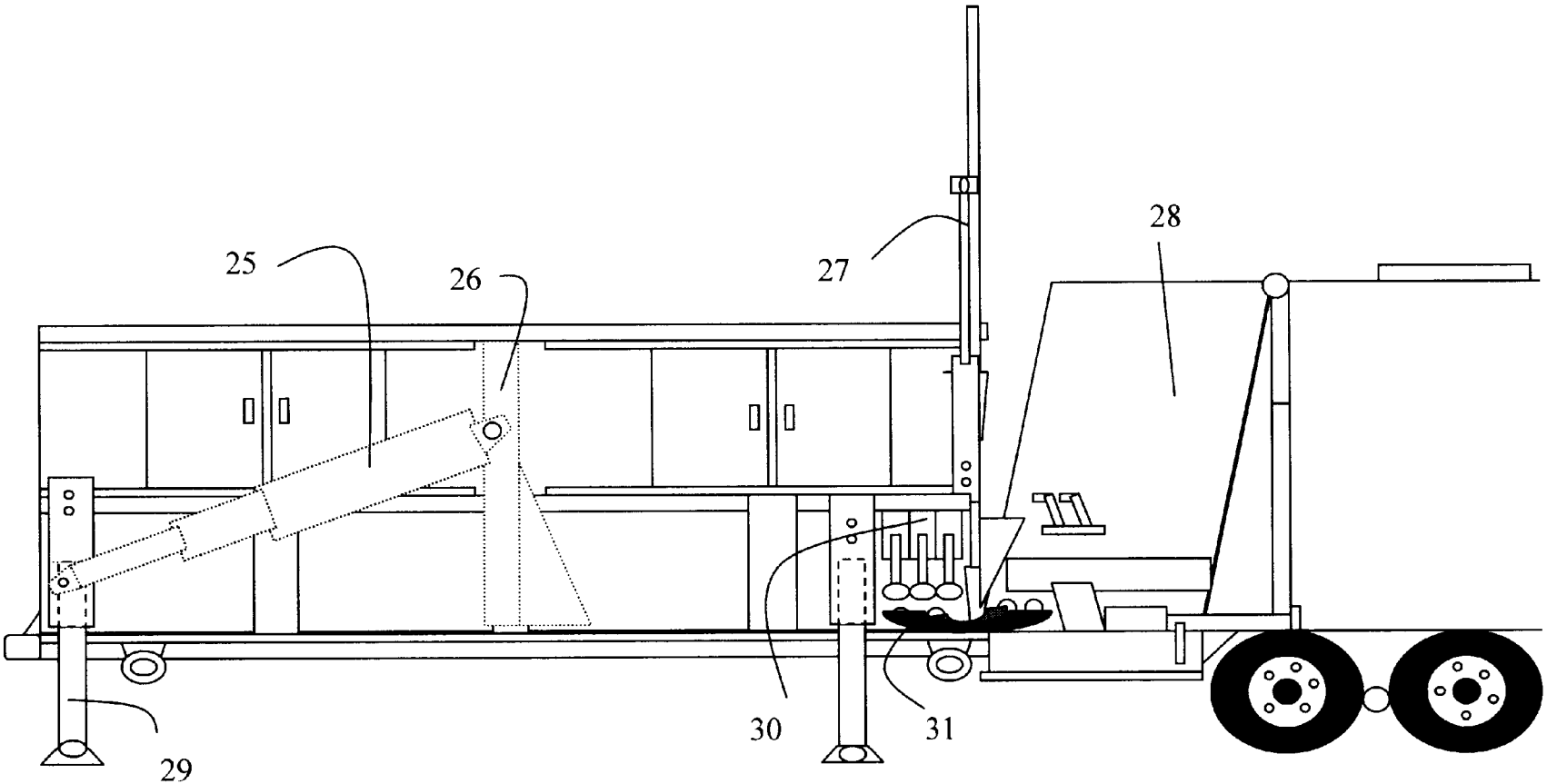
FIG. 5 is a side view of the second embodiment of the invention being serviced by a rear-load garbage truck.

FIG. 4 and FIG. 5 show the embodiments of the invention pictured in FIG. 1 and FIG. 2 when being serviced by a rear-load garbage truck. This is the preferred embodiment of the method invention taught herein. As shown in FIG. 5, rear-load garbage truck hopper 28 is backed up to the door/gate 27. The operator then verifies the legality and safety of his new cargo. The operator attaches hydraulic lines 31 from the truck (conveniently, from hopper 28) to valve body 30, and actuates legs 29. Legs 29 raise the invention from approximately ground level to approximately the level of hopper 28. In alternative embodiments, the invention may be raised to a level higher than that of hopper 28. The operator raises door/gate 27, then the operator actuates ejector cylinder 25, thus pushing blade 26 through the body of the invention and transferring (in this embodiment, ejecting) wastes (not pictured) into hopper 28. At the end of the process, the lifting devices lower the invention to approximately ground level.

In the preferred embodiment and best mode presently contemplated for carrying out the invention, the operator will transfer a portion of the wastes to hopper 28 and then pause transfer operations while cycling compaction blades (not shown) in hopper 28 to move waste into the waste container of the garbage truck. Note that garbage truck may in fact have several different compaction blades. The blades in hopper 28 may serve a primary purpose of moving waste into the waste container. A different set of blades located inside of the waste container may serve as the primary compaction devices. Both sets of blades are referred to as compaction blades for purposes of this invention, however.

Figure 6:
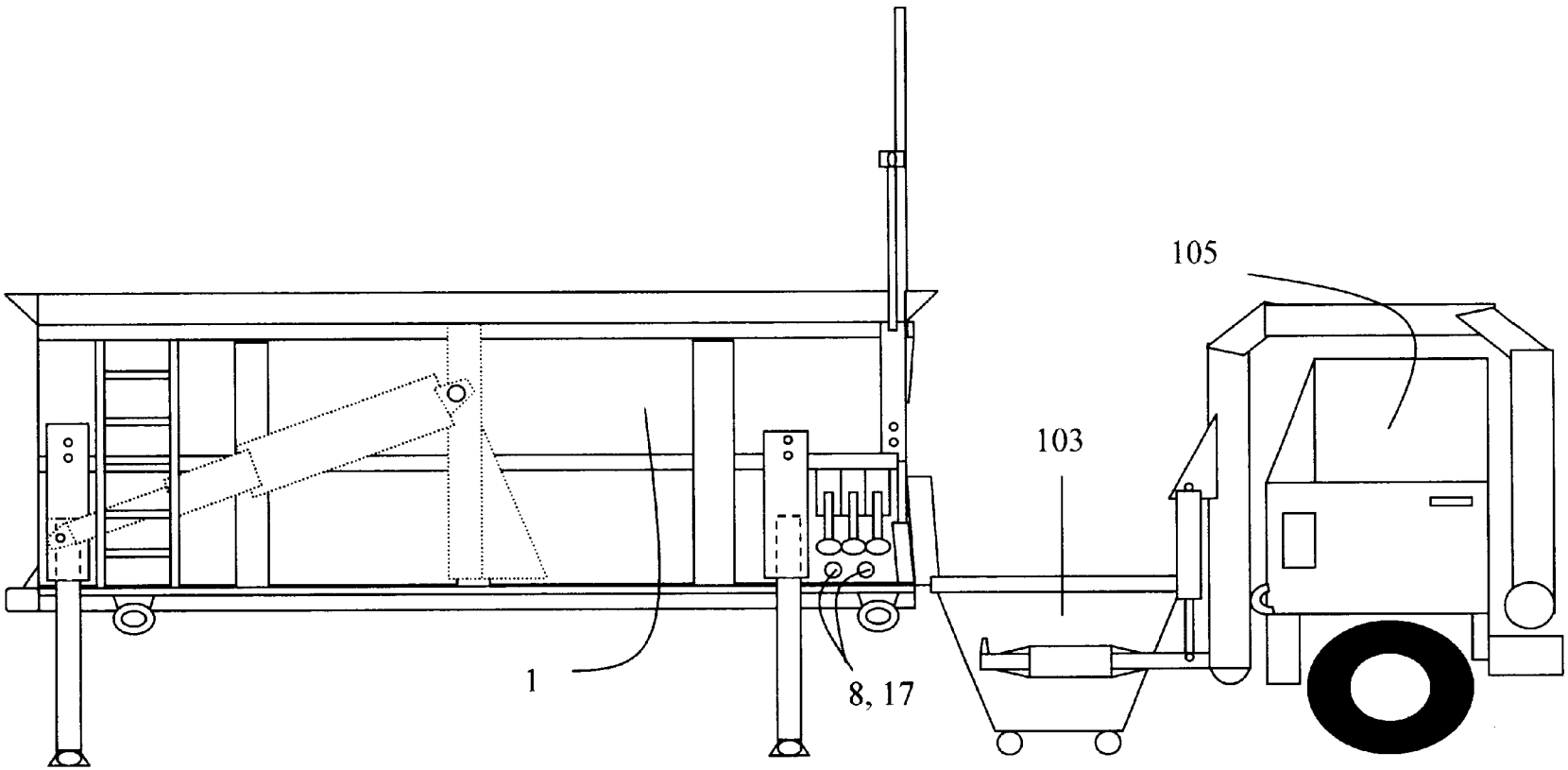
FIG. 6 is a side view of an embodiment of the invention being serviced by a front-load garbage truck.

FIG. 6 shows that the invention may advantageously be serviced by a front-loading garbage truck. Invention body 1 is in the raised position (with the extendable legs extended, per previous discussions and diagrams) and the transfer device is pushing wastes (not pictured) out into front load container 103.

Remote receivers Fallow the operator (not shown) to operate the invention without departing from cab 105.

In operation, the operator drives the front loading vehicle into the configuration shown. Then wet lines may be connected between the vehicle and the invention, though this step may be skipped if the invention is otherwise provided with hydraulic or electrical power. The gate may be raised either manually or by remote control, and a portion of the waste within the invention may be transferred to container 103. The operator may then pause operation of the invention, even closing the gate if necessary, while container 103 is lifted over cab 105 and emptied into the waste container (not shown) of the truck. The operator lowers container 103 back into the configuration depicted and resumes operations.

Some front load trucks have outside controls, in which case the driver may conveniently descend from the cab and operate both sets of controls externally.

Figure 9:
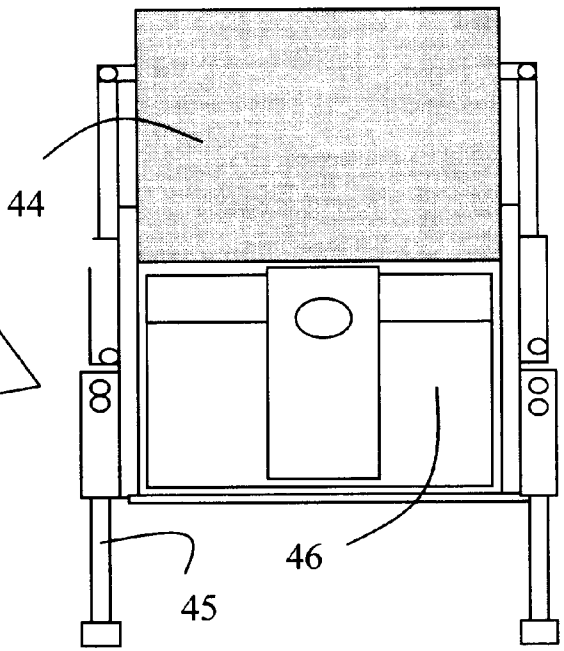
FIG. 9 is a partially elevated end view of the third embodiment of the invention.
Figure 8:
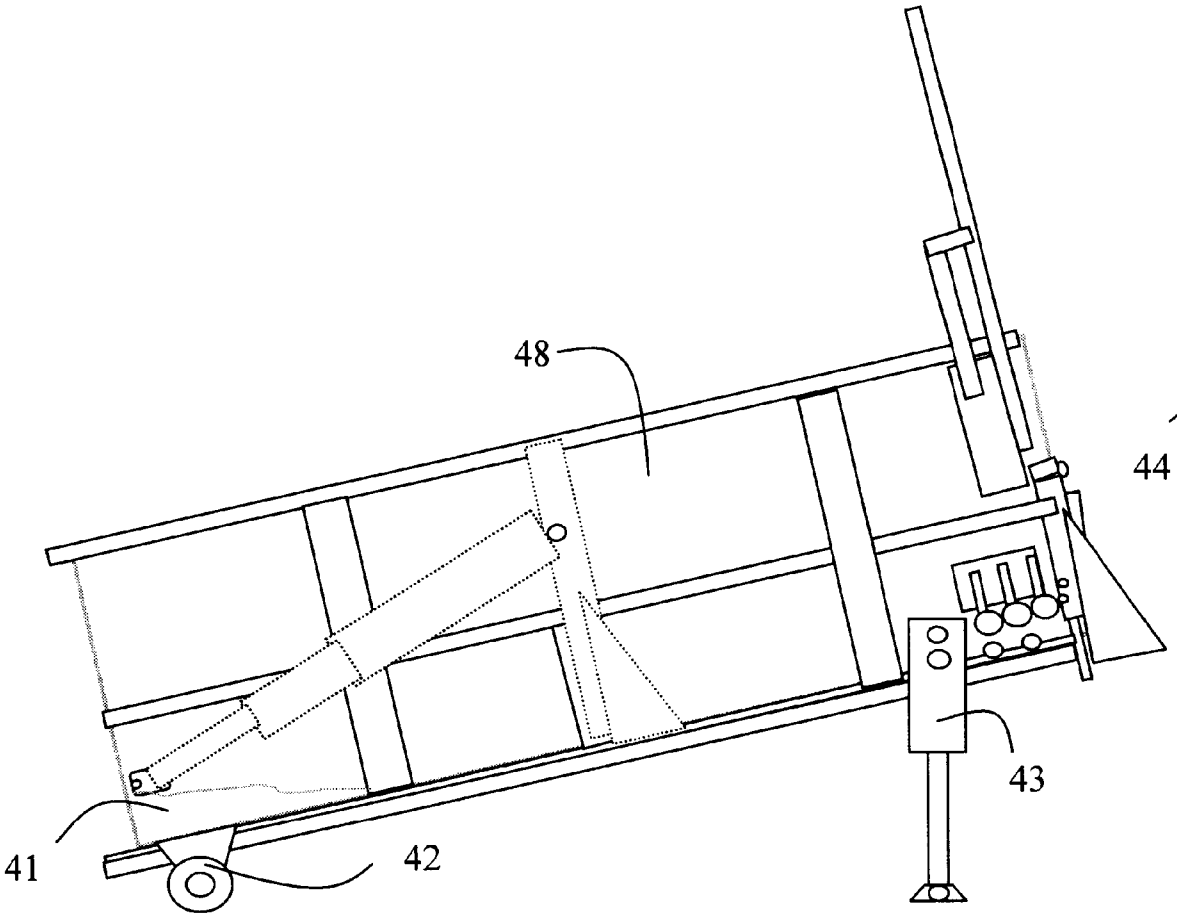
FIG. 8 is a side view of a third embodiment of the invention in raised position.

FIG. 8 and FIG. 9 depict a less favored embodiment of the invention. In this embodiment, the lifting device is extendable legs 45, which only lift one end of the invention. When activated via fluid and/or pressure from the hydraulic ports, hydraulic leg cylinders 43 actuate extendable legs 45, raising one end of the invention to the proper level for transfer. Wheels 42 act as a pivot.

However, liquid or otherwise mobile waste 41 may accumulate inside of body 48 in an unfavorable location behind the transfer mechanism, thus potentially posing sanitation and environmental issues. For that reason, this is not a preferred embodiment.

In the partially elevated end view of this embodiment blade 46 may be seen as door 44 is open. It will be appreciated that the embodiment is raised and the end view of FIG. 9 is also slightly elevated, so as to show the embodiment exactly end on.

Figure 10:
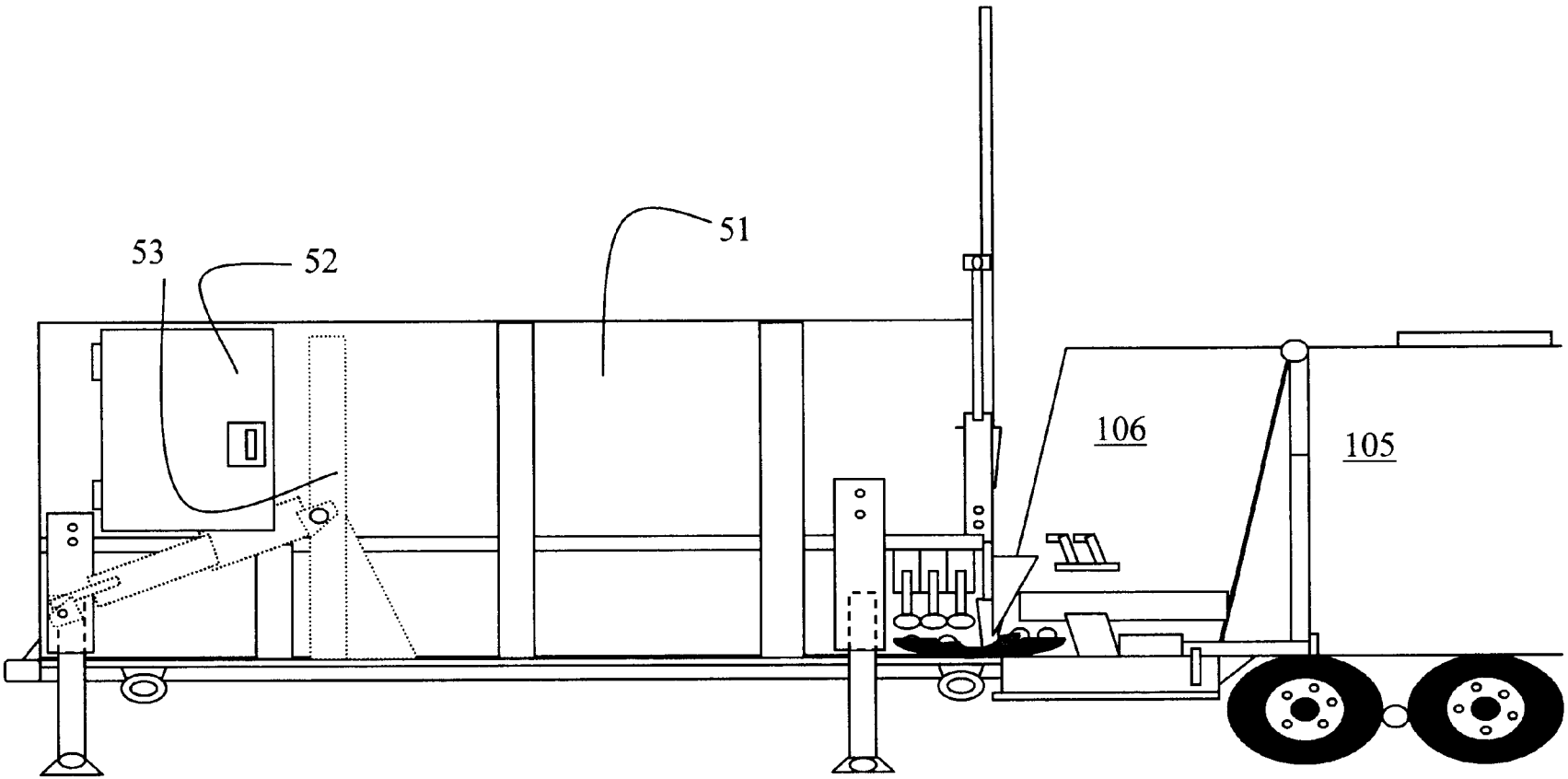
FIG. 10 is a side view of a fourth embodiment of the invention in raised position as it is being serviced by a rear-load garbage truck.

FIG. 10 is a side view of a fourth embodiment of the invention in raised position as it is being serviced by a rear-load garbage truck. In this alternative embodiment, the invention may be equipped to provide trash compaction. Body 51 is able to withstand internal compaction of waste by blade 53, which may be unlike the blades of previous embodiments in that it is able to As It provide not just waste ejection but also compaction. Users may deposit waste in body 51 using door 52. Note that body 51 is covered in compaction embodiments of the present invention.

In the preferred embodiment, this is not necessary as the servicing garbage truck provides such compaction. Compaction of the waste by the servicing truck is desirable for several reasons. First, it obviates the need for compaction devices at each waste container: the compaction device in the truck is brought to each container in turn. Secondly, such compaction (at a ratio ranging from as little as 2 to 1 to as much as 20 to 1, with 10 to 1 being the favored ratio) is desirable in order reduce waste volume. Since most sanitary landfill operators charge by volume, this in turn reduces the costs to the disposal contractor. Stationary compactors usually have a compaction ratio of only 3 to 1, which does not compare favorably to the 7 to 1 ratio of a front load truck and the 10 to 1 or more ratio of the standard rear-load garbage truck.

Figure 11:
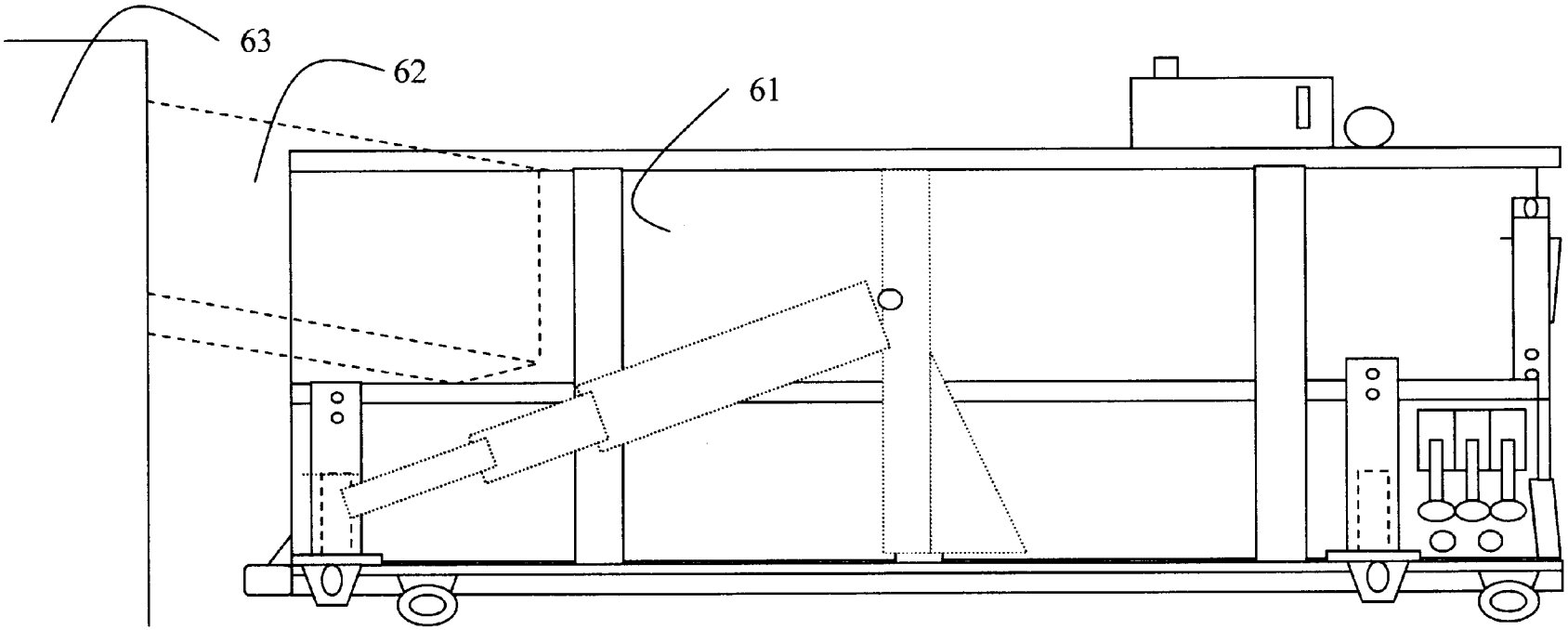
FIG. 11 is a side view of a fifth embodiment of the invention in use by a customer and attached to a building by a chute.

FIG. 11 is a side view of a fifth embodiment of the invention in use by a customer and attached to a building by a chute. In this alternative embodiment of the invention, the invention body 61 may have provision to allow it to function as the receiving end of a trash chute 62 from a building 63. In this embodiment, the invention may be attached by the chute to the interior of the building. Advantageously, the compactor embodiment of FIG. 10 may be combined with this embodiment of FIG. 11.

Electrical actuation of the various structures of the invention may be used in alternative embodiments thereof. The extendable legs may be electrically actuated by a small electrical motor operating a worm drive or other actuator, as may the gate, the transfer mechanism, a compaction device and other equipment on the invention.

The transfer device of the preferred embodiment and best mode now contemplated is a blade ejector which cooperates with the gate to allow easy removal of wastes. However, other transfer devices are possible within the scope of the invention. For example, the floor of the body of the invention may tilt, claws may be used to push, pull or even lift wastes, a conveyor may be built into the floor of the body of the waste container of the invention. One known device consists of alternating and reciprocating slats on the floor, aligned in parallel to the direction of motion of the waste within the container. As the slats alternate in moving back and forth, the waste within is moved in the desired direction. Any such device and others may be used to transfer wastes after the invention has been raised to the height of the hopper.

Containers which may be used with the present invention will normally range in size from 20 to 30 to 40 cubic yards, however, the invention may be implemented with smaller containers, of which there are a multiplicity of known sizes: 6.5 cubic yards, 7.6 cubic yards and so on. The invention may be used with large containers as well.

In terms of energy usage, a large truck making multiple daily round-trips to the landfill represents a large use of petroleum products or other energy sources. By means of the present invention, the number of such trips may be dramatically reduced, and the trucks making the trip may be converted from roll-off hoist trucks to ordinary garbage trucks. The compaction of waste at 3 to 1, 10 to 1 or even 20 to 1 means that many trips can be saved. In every metropolitan area, there are fleets of such trucks capable of doing this by means of the present invention. Thus, the present invention offers the ability to provide great, energy savings. In addition to fuel, the environmental aspect of this is quite large. The emissions generated by a single truck may be greatly reduced by use of the present invention. Such airborne pollution is becoming a greater issue due to global warming, depletion of the ozone layer, metropolitan growth and an increased understanding of the health hazards of such air pollution.

The method of the present invention is also susceptible to various embodiments which may further reduce energy usage. In one alternative embodiment, the waste received by the waste container of the invention may come from another waste container, a garbage truck, or similar waste handling device. By this means, the invention may advantageously serve as an intermediate transfer station between the initial waste receptacle and the final land-fill facility. For example, this embodiment may advantageously be used in a situation in which the waste handling contractor has to service numerous small waste receptacles (such as commercial size containers). It may not be commercially feasible to travel to the landfill facility each time the garbage truck or a conveyor vehicle (such as one which carries several smaller waste containers on its bed or in other special equipment) becomes full to capacity, especially if the land-fill facility is far from the waste containers to be serviced. In that event, the waste handling contractor may transfer waste from small containers (or even a truck) to the invention, then make a reduced number of round trips to the land-fill facility. Waste placed in the waste container may come from a source selected from the group consisting of: smaller waste containers, garbage cans, commercial waste containers, rear-load garbage trucks, front-load garbage trucks, hoppers, waste receptacles, and combinations thereof. Thus, another method of energy savings is taught by use of the present invention.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A method of loading waste to the hopper of a rear-load garbage truck, comprising the steps of:

a) allowing waste to be placed into a waste container at approximately ground level, the waste container having a body and having roll-off equipment, and having at least one lifting device and further having at least one end having a gate dimensioned and configured so as to both swing open horizontally and slide open vertically;

b) raising the waste container by means of the at least one lifting device to approximately the level of the hopper of the rear-load garbage truck; and c) transferring the waste to the hopper of the rear-load garbage truck; and d) lowering the container to approximately ground level.

2. The method of loading waste of claim 1, wherein the at least one lifting device comprises at least one extendable leg.

3. The method of loading waste of claim 2, wherein the at least one extendable leg is hydraulically actuated.

4. The method of loading waste of claim 3, wherein the waste container further comprises a hydraulic connection from the garbage truck, and wherein the hydraulic actuation of the extendable leg is accomplished by supplying fluid and pressure through the hydraulic connection from the garbage truck.

5. The method of loading waste of claim 2, wherein the at least one extendable leg is electrically actuated.

6. The method of loading waste of claim 1, wherein the waste container further comprises a transfer device suitable for carrying out the step of transferring the waste to the hopper.

7. The method of loading waste of claim 6, wherein the waste container further comprises a gate at one end of the waste container and further wherein the transfer device further comprises a hydraulically actuated blade dimensioned and configured so as to force waste within the waste container out through the gate when the hydraulically actuated blade is activated.

8. The method of loading waste of claim 1, further comprising the step of:

d) compacting the waste in the rear-load garbage truck.

9. The method of loading waste of claim 1, wherein the step of raising the waste container further comprises raising one end of the waste container.

10. The method of loading waste of claim 1, wherein the step of raising the waste container further comprises raising all of the body of the waste container.

11. The method of claim 1, wherein the step of allowing waste to be placed within the container further comprises placing such waste in the waste container from a source selected from the group consisting of: smaller waste containers, garbage cans, commercial waste containers, rear-load garbage trucks, front-load garbage trucks, hoppers, waste receptacles, and combinations thereof.

12. A roll-off waste container for use with the hopper of a rear-load garbage truck, the waste container comprising:

roll-off equipment;

a body; and at least one lifting device capable of raising at least one end of the container to approximately the level of such hopper and capable of lowering the waste container to approximately ground level.

13. The waste container of claim 12, wherein the width of the body is in the range from 36 to 98 inches.

14. The waste container of claim 13, wherein the width of the body is in the range from 60 to 84 inches.

15. The waste container of claim 12, wherein the at least one lifting device comprises at least one extendable leg.

16. The waste container of claim 12, further comprising:

a spot mirror located so as to allow a driver of a truck to monitor waste within the container.

17. The waste container of claim 12, further comprising:

at least one remote receiver used to control operations of the invention from a remote location.

18. The waste container of claim 12, wherein the width of the body is approximately equal to the width of such hopper of such rear-load garbage truck.

19. The waste container of claim 14, wherein the width of the body is in the range from 70 to 72 inches.

20. The waste container of claim 12, further comprising:

a gate dimensioned and configured so as to both swing open horizontally and slide open vertically.

21. The waste container of claim 20, further comprising:

a hydraulic gate cylinder operatively connected to the gate and dimensioned and configured so as to force the gate open vertically when the hydraulic gate cylinder is actuated.

22. A roll-off waste compactor for use with the hopper of a rear-load garbage truck, the waste compactor comprising:

a body;

a gate dimensioned and configured so as to both swing open horizontally and slide open vertically;

roll-off equipment;

a compaction device; and at least one lifting device capable of raising at least one end of the compactor to approximately the level of such hopper and capable of lowering the roll-off waste compactor to approximately ground level.

* * * * *